US010597999B2

(12) United States Patent
Peters et al.

(10) Patent No.: US 10,597,999 B2
(45) Date of Patent: Mar. 24, 2020

(54) DOWNHOLE COMPONENT SUPPORT SYSTEMS AND METHODS OF INSTALLATION

(71) Applicants: Volker Peters, Wienhausen (DE); Andreas Peter, Celle (DE)

(72) Inventors: Volker Peters, Wienhausen (DE); Andreas Peter, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 416 days.

(21) Appl. No.: 15/298,297

(22) Filed: Oct. 20, 2016

(65) Prior Publication Data

US 2018/0112501 A1 Apr. 26, 2018

(51) Int. Cl.
*E21B 47/01* (2012.01)

(52) U.S. Cl.
CPC ..... *E21B 47/01* (2013.01); *E21B 47/011* (2013.01)

(58) Field of Classification Search
CPC ..... E21B 47/01; E21B 47/011; E21B 17/16; E21B 17/07; E21B 17/073; E21B 43/12; E21B 34/10
See application file for complete search history.

(56) References Cited

U.S. PATENT DOCUMENTS 3,918,519 A * 11/1975 Cubberly, Jr. ..... E21B 17/1014 166/212
4,299,282 A * 11/1981 Thornton ..... E21B 41/0078 15/104.09
6,134,892 A * 10/2000 Turner ..... E21B 36/003 166/66

OTHER PUBLICATIONS

Beckwith, Robin "Downhole Electronic Components: Achieving Performance Reliability", Society of Petroleum Engineers, Journal of Petroleum Technology, Aug. 2013 (12 pages).

* cited by examiner

*Primary Examiner* — George S Gray
(74) *Attorney, Agent, or Firm* — Cantor Colburn LLP

(57) ABSTRACT

Downhole component support systems and methods including a housing having a housing cavity therein, the housing cavity configured to contain a hydraulic frame and a hydraulic frame configured to support at least one component package removably disposed within the housing cavity. At least one master hydraulic assembly is in hydraulic communication with the hydraulic frame and at least one slave hydraulic assembly is coupled to the hydraulic frame and hydraulically coupled to the at least one master hydraulic assembly. Adjustment of the at least one master hydraulic assembly urges the at least one slave hydraulic assembly between a first position and a second position, and, when in the second position, the hydraulic frame is secured to an interior surface of the housing.

23 Claims, 9 Drawing Sheets

DOWNHOLE COMPONENT SUPPORT SYSTEMS AND METHODS OF INSTALLATION

BACKGROUND

1. Field of the Invention

The present invention generally relates to downhole tools and more particularly to downhole component support systems and methods of installation.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In more detail, wellbores or boreholes for producing hydrocarbons (such as oil and gas) are drilled using a drill string that includes a tubing made up of, for example, jointed tubulars or continuous coiled tubing that has a drilling assembly, also referred to as the bottom hole assembly (BHA), attached to its bottom end. The BHA typically includes a number of electronic components and/or other component packages. During operation (e.g., drilling, exploration, production, etc.) the electronics or other component packages can be subject to differential movements, vibrations, etc., and thus can be subject to damage. Further, installation of the electronics/component packages can be cumbersome and difficult when attempting to perform maintenance thereon and/or repair/replace such packages. Accordingly, it may beneficial to develop new ways to support the electronics within the housings.

SUMMARY

Disclosed herein are systems and methods for installing component packages within downhole tools. The systems and methods include a housing having a housing cavity therein, the housing cavity configured to contain a hydraulic frame and a hydraulic frame configured to support at least one component package removably disposed within the housing cavity. At least one master hydraulic assembly is in hydraulic communication with the hydraulic frame and at least one slave hydraulic assembly is coupled to the hydraulic frame and hydraulically coupled to the at least one master hydraulic assembly. Adjustment of the at least one master hydraulic assembly urges the at least one slave hydraulic assembly between a first position and a second position and, when in the second position, the hydraulic frame is secured to an interior surface of the housing.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are methods and apparatus for installing and supporting electronics and component packages in downhole tools, particularly within cavities of housings that are configured to contain the electronics. Various embodiments herein are directed to hydraulic frames and support systems that enable easy installation, removable, and secure clamping within the housing. Embodiments described herein are directed to hydraulic systems with master-slave hydraulic assemblies.

Figure 1A:
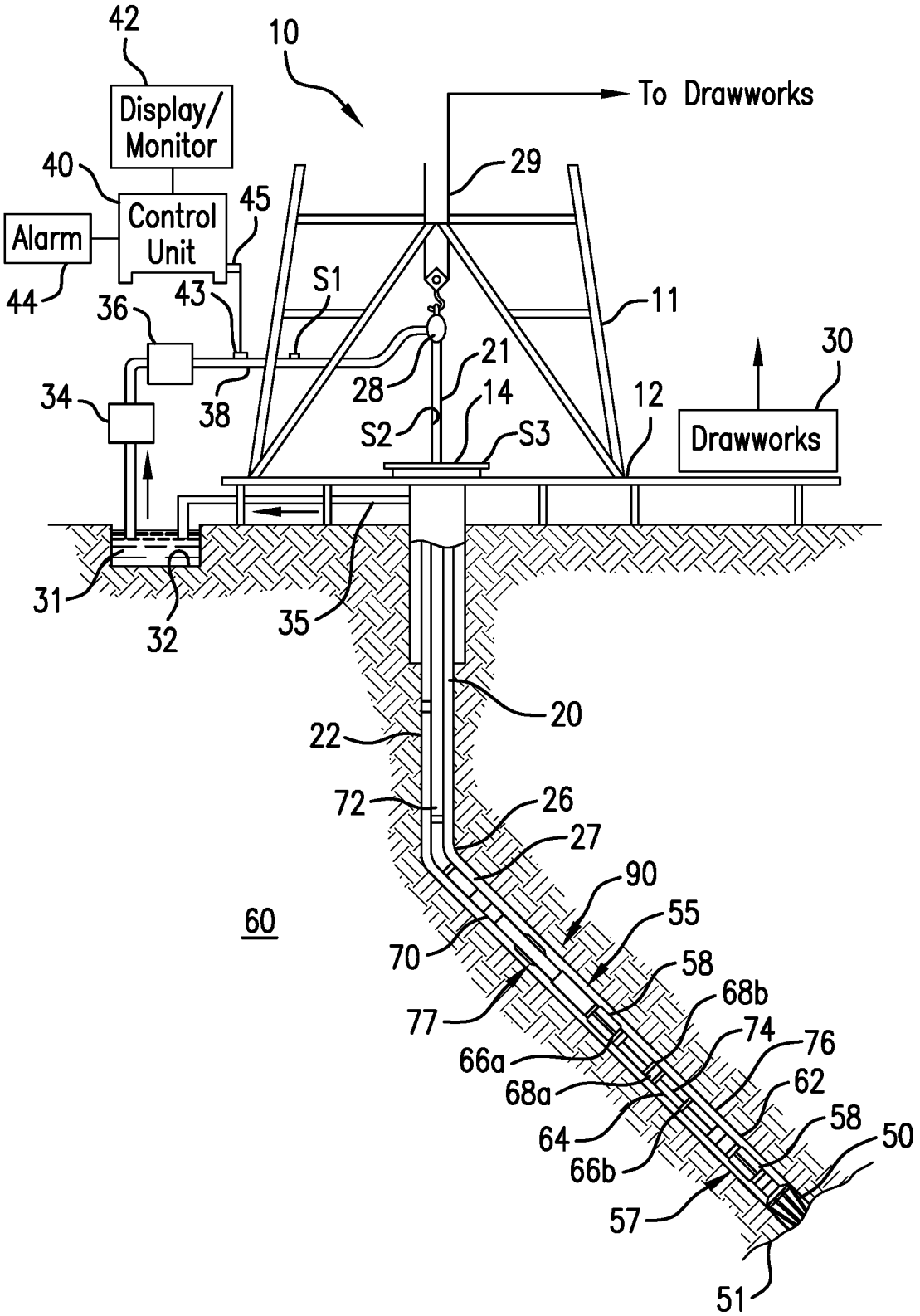
FIG. 1A is an example drilling system that can employ embodiments of the present disclosure.

FIG. 1A shows a schematic diagram of a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1A, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1A, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1A, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Figure 1B:
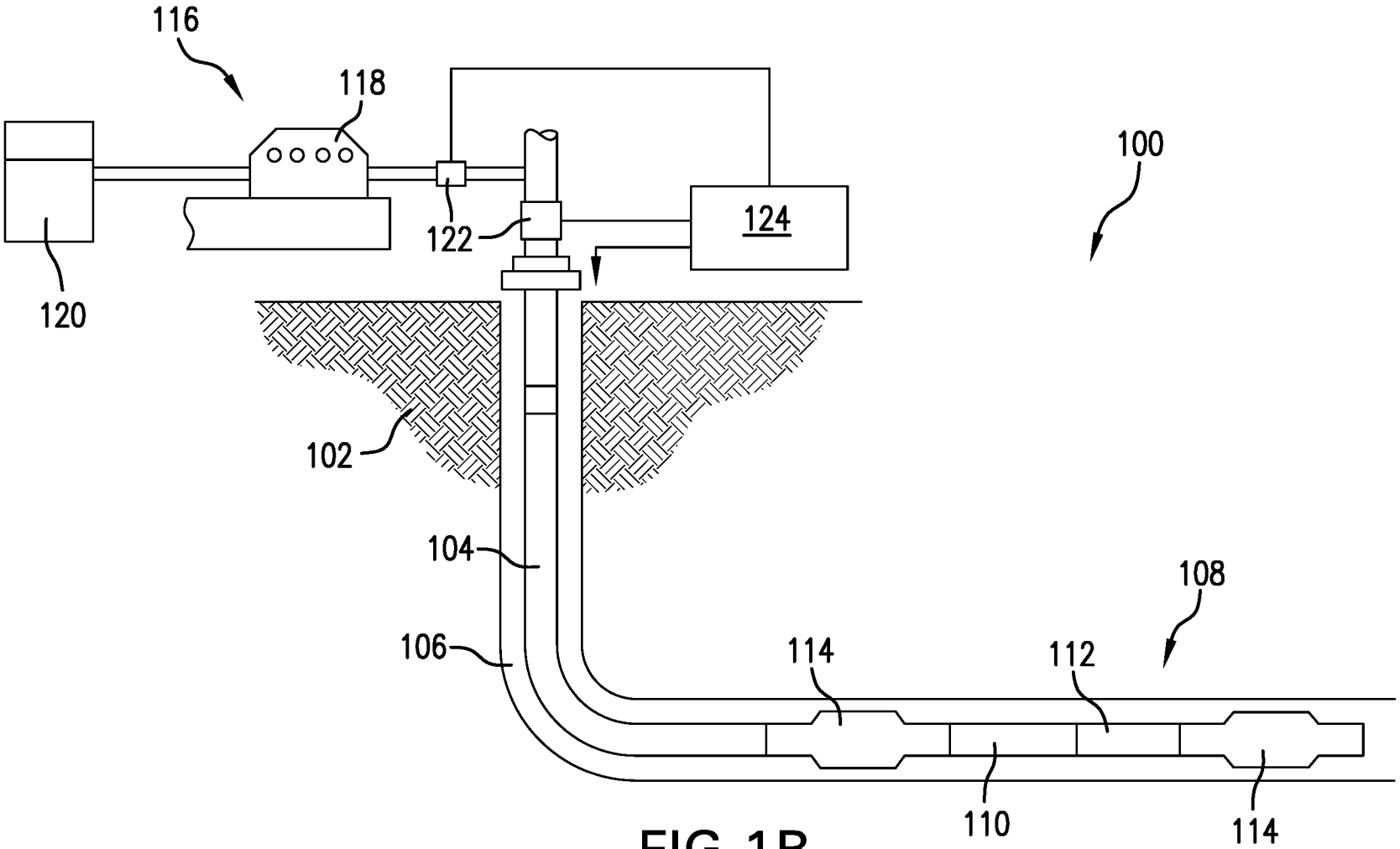
FIG. 1B depicts a system for formation stimulation and hydrocarbon production that can incorporate embodiments of the present disclosure.

Turning now to FIG. 1B, a schematic illustration of an embodiment of a system 100 for hydrocarbon production and/or evaluation of an earth formation 102 that can employ embodiments of the present disclosure is shown. The system 100 includes a borehole string 104 disposed within a borehole 106. The string 104, in one embodiment, includes a plurality of string segments or, in other embodiments, is a continuous conduit such as a coiled tube. As described herein, "string" refers to any structure or carrier suitable for lowering a tool or other component through a borehole or connecting a drill bit to the surface, and is not limited to the structure and configuration described herein. The term "carrier" as used herein means any device, device component, combination of devices, media, and/or member that may be used to convey, house, support, or otherwise facilitate the use of another device, device component, combination of devices, media, and/or member. Example, non-limiting carriers include, but are not limited to, casing pipes, wirelines, wireline sondes, slickline sondes, drop shots, downhole subs, bottomhole assemblies, and drill strings.

In one embodiment, the system 100 is configured as a hydraulic stimulation system. As described herein, "stimulation" may include any injection of a fluid into a formation. A fluid may be any flowable substance such as a liquid or a gas, or a flowable solid such as sand. In such embodiment, the string 104 includes a downhole assembly 108 that includes one or more tools or components to facilitate stimulation of the formation 102. For example, the string 104 includes a fluid assembly 110, such as a fracture or "frac" sleeve device or an electrical submersible pumping system, and a perforation assembly 112. Examples of the perforation assembly 112 include shaped charges, torches, projectiles, and other devices for perforating a borehole wall and/or casing. The string 104 may also include additional components, such as one or more isolation or packer subs 114.

One or more of the downhole assembly 108, the fracturing assembly 110, the perforation assembly 112, and/or the packer subs 114 may include suitable electronics or processors configured to communicate with a surface processing unit and/or control the respective tool or assembly.

A surface system 116 can be provided to extract material (e.g., fluids) from the formation 102 or to inject fluids through the string 104 into the formation 102 for the purpose of fraccing.

As shown, the surface system 116 includes a pumping device 118 in fluid communication with a tank 120. In some embodiments, the pumping device 118 can be used to extract fluid, such as hydrocarbons, from the formation 102, and store the extracted fluid in the tank 120. In other embodiments, the pumping device 118 can be configured to inject fluid from the tank 120 into the string 104 to introduce fluid into the formation 102, for example, to stimulate and/or fracture the formation 102.

One or more flow rate and/or pressure sensors 122, as shown, are disposed in fluid communication with the pumping device 118 and the string 104 for measurement of fluid characteristics. The sensors 122 may be positioned at any suitable location, such as proximate to (e.g., at the discharge output) or within the pumping device 118, at or near a wellhead, or at any other location along the string 104 and/or within the borehole 106.

A processing and/or control unit 124 is disposed in operable communication with the sensors 122, the pumping device 118, and/or components of the downhole assembly 108. The processing and/or control unit 124 is configured to, for example, receive, store, and/or transmit data generated from the sensors 122 and/or the pump 118, and includes processing components configured to analyze data from the pump 118 and the sensors 122, provide alerts to the pump 118 or other control unit and/or control operational parameters, and/or communicate with and/or control components of the downhole assembly 108. The processing and/or control unit 124 includes any number of suitable components, such as processors, memory, communication devices and power sources.

In the configurations of FIGS. 1A-1B, downhole components can include electronic modules or electronic devices that are used for various functions, including, but not limited to, control functions, monitoring functions, communication functions, etc. The electronics can be mounted within a cavity of the downhole system. For example, different sections of tubing, piping, bottomhole assemblies, and/or other downhole structures (e.g., housings, casings, support structures, frames, probe sections, etc.), hereinafter referred to collectively as a "housing." The mounting may be required to secure the electronics within the housing. However, during downhole operations, the electronics within the housing may be subject to vibrations or other differential movement. It may be desirable to minimize such differential movement.

Accordingly, embodiments provided herein are directed to support structures and systems for electronics in downhole systems (e.g., electronic packages, electronic modules, electronic components, etc.) that provide dampening and/or clamping to prevent movement of the electronics within a cavity of a housing. Further, various embodiments provided herein may provide additional functionality, including, but not limited to, improve thermal cooling for the electronics.

Figure 2A:
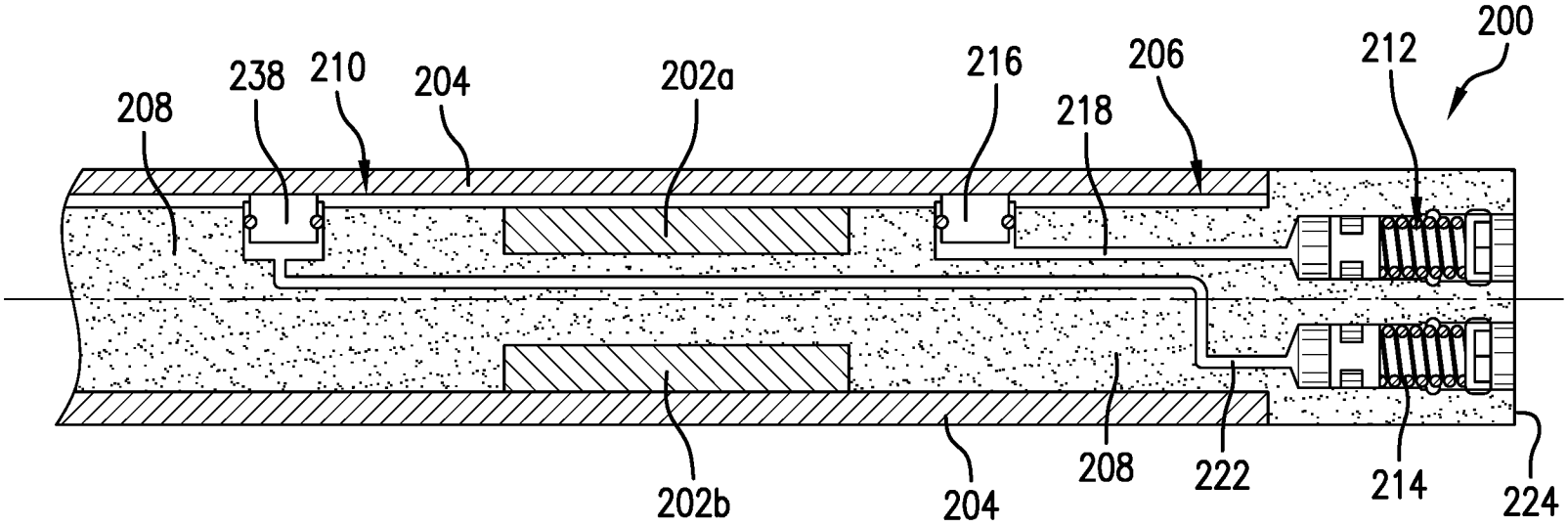
FIG. 2A is a schematic illustration of a downhole component support system in accordance with an embodiment of the present disclosure.
Figure 2B:
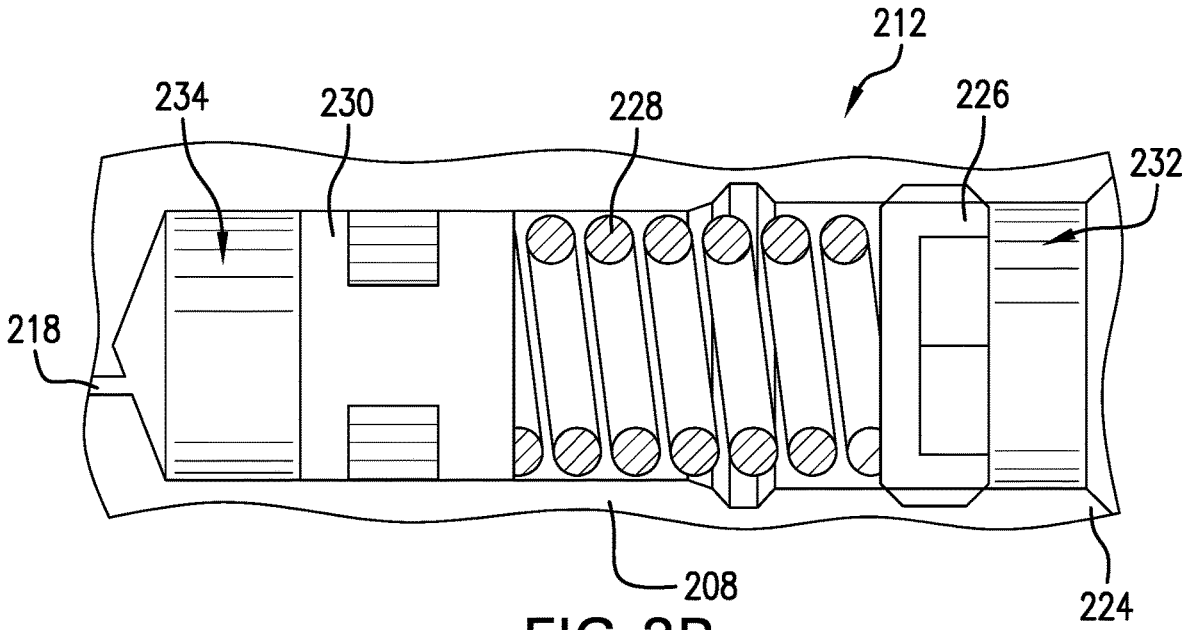
FIG. 2B is an enlarged schematic illustration of a portion of the downhole component support system of FIG. 2A.
Figure 2C:
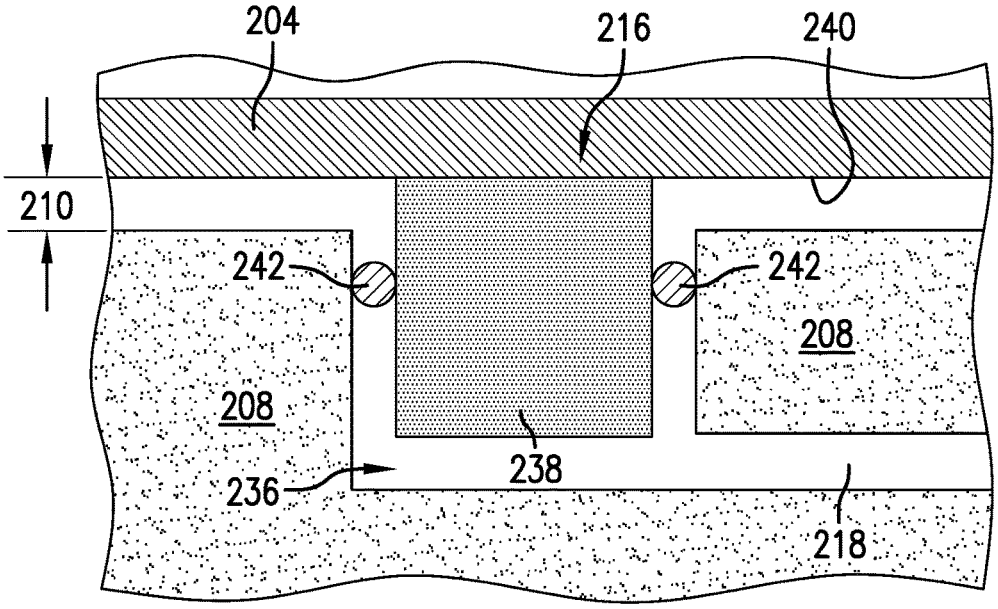
FIG. 2C is an enlarged schematic illustration of another portion of the downhole component support system of FIG. 2A.

For example, turning now to FIGS. 2A-2C, schematic illustrations of a downhole component support system 200 in accordance with an embodiment of the present disclosure is shown. FIG. 2A is a schematic illustration of the downhole component support system 200 as installed within a housing 204. FIG. 2B is an enlarged illustration of a master hydraulic assembly 212 of the downhole component support system 200 of FIG. 2A and FIG. 2C is an enlarged illustration of a slave hydraulic assembly 216 of the downhole component support system 200 of FIG. 2A.

The downhole component support system 200 is configured to carry and support one or more component packages 202*a*, 202*b* within the housing 204. Each component package 202*a*, 202*b* can include various parts, devices, and/or mechanical and/or electrical components that may be used in downhole operations, including, but not limited to, control components, sensor components, monitoring components, communication components, etc. In some embodiments, the component package(s) are electronic packages. The housing 204 can be a tubular, a pressure barrel, part of a pipe string, or other housing that defines a housing cavity 206 therein. In some embodiments, the housing 204 can be formed from metal. Further, in some embodiments the housing wall 204 can be a hatch cover that can be bolted or otherwise attached to a mandrel and sealed as known in the art. That is, those of skill in the art will appreciate that the housing wall 204 is not limited to the presently shown illustrative schematic but can be a housing wall of any configuration used in downhole tools and systems.

The electronic packages 202*a*, 202*b* are retained or installed in or on a hydraulic frame 208. The hydraulic frame 208 can be shaped, sized, and/or otherwise configured to fit within the housing cavity 206 of the housing 204. That is, the hydraulic frame 208 can be installed into and removed from the housing 204, thus allowing installation, repair, replacement, inspection, and/or maintenance to be performed on the component packages 202*a*, 202*b*, other parts of the hydraulic frame 208, and/or to allow access to the interior of the housing 204 (e.g., access to the housing cavity 206). Those of skill in the art will appreciate that embodiments described herein are not limited to probe-based embodiments/configuration. For example, the hydraulic frame can alternatively be a part of a drilling load carrying component, with the housing wall being established by a cover sleeve, hatch cover, or other suitable element(s).

As illustrated in FIG. 2A, a gap 210 exists between an exterior surface of the hydraulic frame 208 and an interior surface of the housing 204 (see also FIG. 2C). The hydraulic frame 208 can be constructed to form the gap 210 when installed in the housing 204 to enable installation or removal of the hydraulic frame 208 from the housing 204. That is, to enable installation, an external diameter or shape of the hydraulic frame 208 is smaller or sized to fit within the housing cavity 206 of the housing 204. Thus, the hydraulic frame 208 can be installed into and removed from the housing cavity 206.

To ensure engagement and secure the hydraulic frame 208 within the housing 204, the downhole component support system 200 includes a hydraulic mechanism for enabling engagement and disengagement. For example, as shown, a first master hydraulic assembly 212 and a second master hydraulic assembly 214 are configured at an end 224 of the hydraulic frame 208. Each master hydraulic assembly 212, 214 is hydraulically coupled or connected with a respective slave hydraulic assembly. For example, as shown, the first master hydraulic assembly 212 is hydraulically coupled to a first slave hydraulic assembly 216 by a first fluid line 218. Similarly, the second master hydraulic assembly 214 is hydraulically coupled to a second slave hydraulic assembly 220 by a second fluid line 222.

As used herein, and with respect to the embodiment of FIG. 2, the master-slave terminology is merely used to distinguish different hydraulic assemblies. In the present configuration, operation or actuation of the master hydraulic assembly affects a change in state or change in actuation of the respective slave hydraulic assembly. Accordingly, an operator (automated, computer, electrical, human, etc.) can change a state of a master hydraulic assembly to cause an effect that is achieved through operation or actuation of a respective slave hydraulic assembly.

The master hydraulic assemblies 212, 214, as shown, are accessible from an end 224 of the hydraulic frame 208. Access can be by a human operator using a tool to access and adjust the master hydraulic assemblies 212, 214 and/or an electrical, mechanical, hydraulic, or other type of control connection can be operably connected to the master hydraulic assemblies 212, 214.

The slave hydraulic assemblies 216, 220 are configured to actuate from a first position (e.g., disengaged, retracted, or flush with or within the exterior surface of the hydraulic frame 208) to a second position (e.g., engaged, extended, or extending outward from the exterior surface of the hydraulic frame 208). As illustrated in FIG. 2A, the slave hydraulic assemblies 216, 220 are in the second position. In the second position, a portion of each of the slave hydraulic assemblies 216, 220 can engage with an interior surface of the housing 204. Further, in the second position, the slave hydraulic assemblies 216, 220 can apply force against the interior surface of the housing 204, and thus securing and retaining the hydraulic frame 208 within the cavity 210 of the housing 204. The engagement of the slave hydraulic assemblies 216, 220 with the housing 204 can prevent differential movement of the component packages 202*a*, 202*b* and/or the hydraulic frame 208 relative to the housing 204.

Turning now to FIG. 2B, an enlarged illustration of the first master hydraulic assembly 212 is schematically shown. Although the discussion herein is being made with respect to the first master hydraulic assembly 212, the second master hydraulic assembly 214 is substantially similar. As shown, the master hydraulic assembly 212 includes a control element 226, a master biasing element 228, and a master actuator 230, such as a piston, plunger, bellows, or other structure. In some embodiments the biasing element 228 is not required to adjust the pressure of the master-slave hydraulics. For example, as the master biasing element 228 is adjusted, the hydraulic fluid could be used to account for elastic properties, e.g., through adding a gas volume into the hydraulic system. Further, other options include elastic or plastic flexibility elements in hydraulic communication with the master and/or slave assemblies. The pressure inside the hydraulic system can be selected to compress the hydraulic frame against the interior of the housing cavity 206 with a force high enough to suppress any differential movement at the contacting position between the hydraulic frame and the interior of the housing cavity up to a selected severity of acceleration caused by shock and vibration loads. For those skilled in the art, the calculation of the required force and respective pressure can be calculated (amongst others) by the proportional mass of the components, their structural shape and material, and operational acceleration and frequency, for example.

The control element 226 can be operated to adjust the position of the control element 226 within a bore 232 of the hydraulic frame 208 that opens on an end 224 of the hydraulic frame 208. In some embodiments, the control element 226 and the bore 232 can be threaded such that the control element 226 can be rotated to adjust the position of the control element 226 within the bore 232. As position of the control element 226 is adjusted inward relative to the end 224, the control element 226 can force the master actuator 230 to move within the bore 232 to act upon hydraulic fluid within a master assembly cavity 234. The master assembly cavity 234 is fluidly connected to the first fluid line 218, as shown in FIGS. 2A-2B. The master biasing element 228 can be configured to enable energization of the master actuator 230. In some configurations, the master biasing element 228 can have a relatively flat force-versus-displacement characteristic to ensure no additional pressure or force is applied to thus alter or influence the hydraulic pressure within the downhole component support system 200 as, for example, a result of volumetric changes of the hydraulic fluid caused by temperature changes. The relatively flat force-versus-displacement curve would consequently cause small pressure or force changes upon such volumetric changes. Other sources of volume changes can include, but are not limited to, thermal expansion. Further, in some embodiments, the master biasing element 228 can be configured with a compression, e.g., by use of a spring, to set a hydraulic pressure in the downhole component support system 200.

In operation, as the master actuator 230 is moved to shrink the master assembly cavity 234, hydraulic fluid within the master assembly cavity 234 is forced into and through the first fluid line 218. As shown in FIG. 2C, the first fluid line 218 is fluidly connected to the first slave hydraulic assembly 216 at a slave assembly cavity 236. The hydraulic fluid enters the slave assembly cavity 236 and applies force upon a slave actuator 238, such as a piston or other structure. The slave actuator 238 will be urged outward relative to the slave assembly cavity 236 and the slave actuator 238 can engage with an interior surface 240 of the housing 204. Also shown in FIG. 2C are optional fluid seals 242 that are configured to prevent hydraulic fluid from leaking from the slave assembly cavity 236 while allowing movement or actuation of the slave actuator 238. In some embodiments, the fluid seals can be flexible elements, such as bellows.

In some embodiments, the slave actuator 238 can be biased toward the first position (e.g., mechanically, hydraulically, etc.). When the master actuator 230 is controlled to enlarge the master assembly cavity 234, the hydraulic fluid will flow from the slave assembly cavity 236 through the first fluid line 218 and into the master assembly cavity 234. As this happens, the slave actuator 238 will disengage from the interior surface 240 of the housing 204 and move into the first position. Because of the presence of the gap 210, with the slave actuator 238 in the first position, the hydraulic frame 208 can be removed from the housing 204.

As will be appreciated by those of skill in the art, as shown in FIGS. 2A-2C, each master hydraulic assembly 212, 214 can be independently or separately operated such that the first and second slave hydraulic assemblies 216, 220 can be independently operated. However, in some configurations, a single master hydraulic assembly can be coupled to and configured to control multiple slave hydraulic assemblies.

Further, although shown as a single, unitary structure, those of skill in the art will appreciate that the hydraulic frame can be constructed from multiple sub parts. For example, a head can be configured to contain the master hydraulic assemblies and a separate body can be configured to contain the slave hydraulic assemblies. In such an example, various seals and/or connectors can be employed to ensure alignment of the fluid lines and thus ensure hydraulic coupling between master hydraulic assemblies and slave hydraulic assemblies.

The illustrative configuration of FIGS. 2A-2C can allow for easy installation and fixed engagement between the hydraulic frame and the housing in which the hydraulic frame is installed. Accordingly, a secure support for the hydraulic frame is provided and yet ease of installation is enabled. That is, secure clamping of the hydraulic frame within the housing is possible with embodiments of the present disclosure. Additionally, embodiments of the present disclosure can enable improved thermal cooling for the component packages installed to the hydraulic frame. For example, with reference to FIG. 2A, the component package 202*b* is pushed into contact with the interior surface 240 of the housing 204. Such contact can enable thermal transfer from the component package 202*b* into the material of the housing 204. That is, the housing 204 or a portion thereof can operate as a heat sink for the component package 202*b*.

Although shown in FIGS. 2A-2C having a particular shape and configuration, those of skill in the art will appreciate that the slave actuators can have various different structures, shapes, or configurations without departing from the scope of the disclosure. For example, the slave actuators can form point, surface, or line contact with the interior surface of the housing without departing from the scope of the present disclosure. In some embodiments, the position, shape, and size of the slave actuators can be selected and defined to enable creation of resonant nodes at dedicated positions within the housing, and thus provide additional benefits to supporting the component packages within the hydraulic frame.

Advantageously, embodiments of the present disclosure can enable controllable clamping of an hydraulic frame within a housing. Further, advantageously, such clamping can prevent vibration and/or differential movement of the hydraulic frame within the housing. Additionally, as described above, the master hydraulic assembly configuration can enable force-free installation and/or removal of the hydraulic frame from the housing. That is, because the hydraulic pressure of the downhole component support system 200 can be adjusted using the master hydraulic assemblies, and thus engagement between the hydraulic frame and the housing is controllable, an operator is not required to force-fit (e.g., interference fit or otherwise) install the hydraulic frame into the housing. Additionally, downhole component support systems of the present disclosure can allow for housing compression from ambient pressure with a stroke reaction of the hydraulic pistons. In contrast to prior configurations, the possibility to stroke as a reaction upon pressure induced housing deformation allows to limit or control compression forces acting on the hydraulic frame and/or the component package(s).

Although shown in FIG. 2A with the slave hydraulic assemblies on a single side of the hydraulic frame, embodiments of the present disclosure are not so limited. For example, one or more slave hydraulic assemblies can be installed or configured at various different locations and/or positions on the hydraulic frame to enable engagement in various manners.

Although described above with respect to a particular configuration and example, the described master/slave hydraulic system(s) may be used to fix, mount, attach, retain, and/or lock devices or members other than electronics. For example, in some embodiments, systems described herein can be used to fix, mount, attach, retain, and/or lock antennas or other equipment located on a circumference of a drilling tool body to the drilling tool. In other embodiments, the systems described herein can be used to fix, mount, attach, retain, and/or lock sensor modules into cavities of a tool body. As will be appreciated by those of skill in the art, systems as provided herein can eliminate the need or use of screws, bolts, or other mechanical attachment mechanisms and/or devices.

Figure 3:
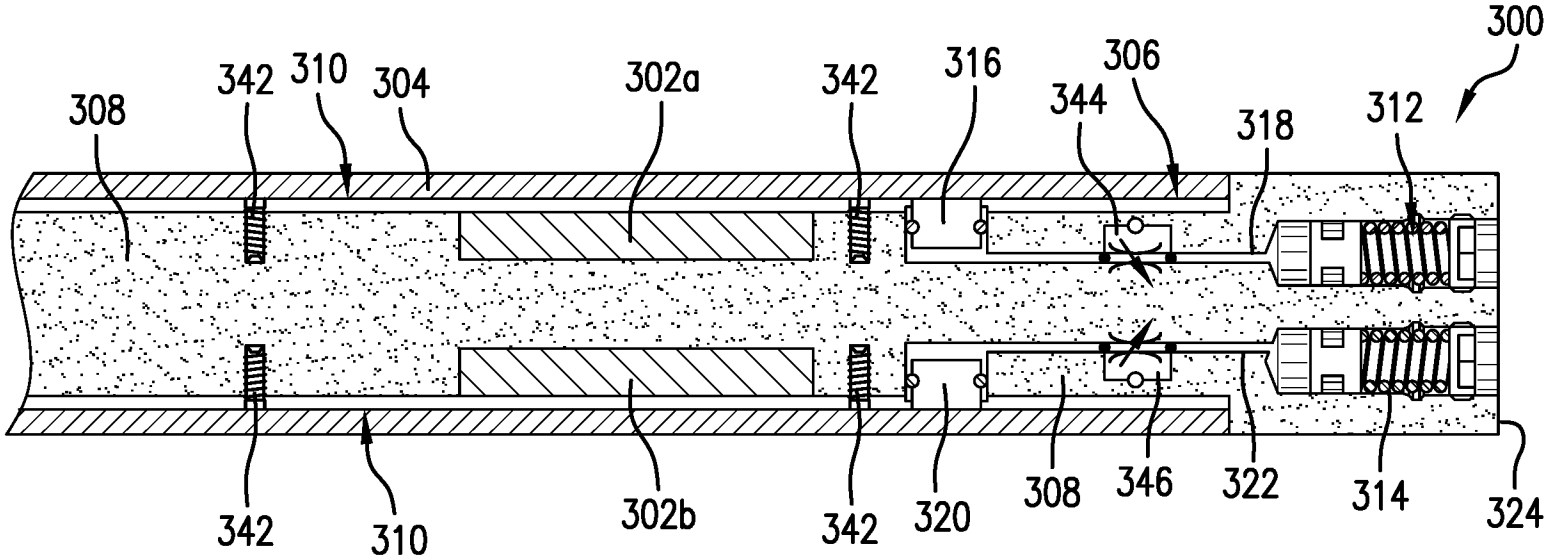
FIG. 3 is a schematic illustration of another non-limiting embodiment of a downhole component support system in accordance with the present disclosure.

Turning now to FIG. 3, an alternative configuration of a downhole component support system 300 in accordance with an embodiment of the present disclosure is shown. The downhole component support system 300 includes an hydraulic frame 308 that supports component packages 302*a*, 302*b*. The hydraulic frame 308 is configured to fit within a housing cavity 306 of a housing 304. In the embodiment of FIG. 3, the downhole component support system 300 includes master hydraulic assemblies 312, 314 and respective slave hydraulic assemblies 316, 320 which are fluidly connected by first and second fluid lines 318, 322, similar to that described above.

As shown in FIG. 3, instead of having the slave hydraulic assemblies installed on the same or similar side or circumferential location on the hydraulic frame 308, the slave hydraulic assemblies 316, 320 of the downhole component support system 300 are positioned at different circumferential locations. Accordingly, instead of urging the hydraulic frame toward a specific location and thus contact an interior surface of the housing, the downhole component support system 300 is configured to centralize the hydraulic frame 308 within the housing cavity 306.

In such configurations, as shown in FIG. 3, the downhole component support system 300 can include frame biasing elements 342. The frame biasing elements 342 can be, in some embodiments, fixedly attached to or otherwise connected to the hydraulic frame 308. Multiple frame biasing elements 342 can be configured such that a portion of each frame biasing element 342 can engage with the interior surface of the housing 304 and thus support or otherwise retain or hold the hydraulic frame 308 within the housing cavity 306 of the housing 304. The frame biasing elements 342 can be springs or other biasing structures or components, as known in the art.

The downhole component support system 300 of FIG. 3 also includes flow control elements 344, 346 that are coupled to the first and second fluid lines 318, 322. The flow control elements 344, 346 can be nozzles, restrictors, check valves, other types of valves, or other type of flow control as will be appreciated by those of skill in the art. The flow control elements 344, 346 can be configured to all for one-way and/or controlled flow between the master hydraulic assemblies 312, 314 and the respective slave hydraulic assemblies 316, 320.

In some embodiments, the combination of the flow control elements 344, 346 and the slave hydraulic assemblies 316, 320 can enable an active or passive damping system to further isolate the component packages 302*a*, 302*b* from damage due to differential movement and/or vibrations. In some embodiments, the flow control elements 344, 346 can be configured to prevent the hydraulic frame 308 from contacting an interior surface of the housing 304. That is, the flow control elements 344, 346 can operate as hydraulic pressure regulators to prevent one or more of the slave hydraulic assemblies from extending sufficiently such that a portion of the hydraulic frame 308 contacts the interior surface of the housing 304.

In some embodiments that incorporate the frame biasing elements, the number of slave hydraulic assemblies can be selected to ensure proper operation and control of the position of the hydraulic frame. For example, depending on the shape and configuration of the slave hydraulic assemblies, three slave hydraulic assemblies can be configured about a circumference of the hydraulic frame. In such embodiment, each of the slave hydraulic assemblies can be positioned 120 degrees from the other slave hydraulic assemblies. In other embodiments more than three slave hydraulic assemblies can be used. In various embodiments, the slave hydraulic assemblies can be equally spaced or distributed about a circumference of the hydraulic frame.

Figure 4A:
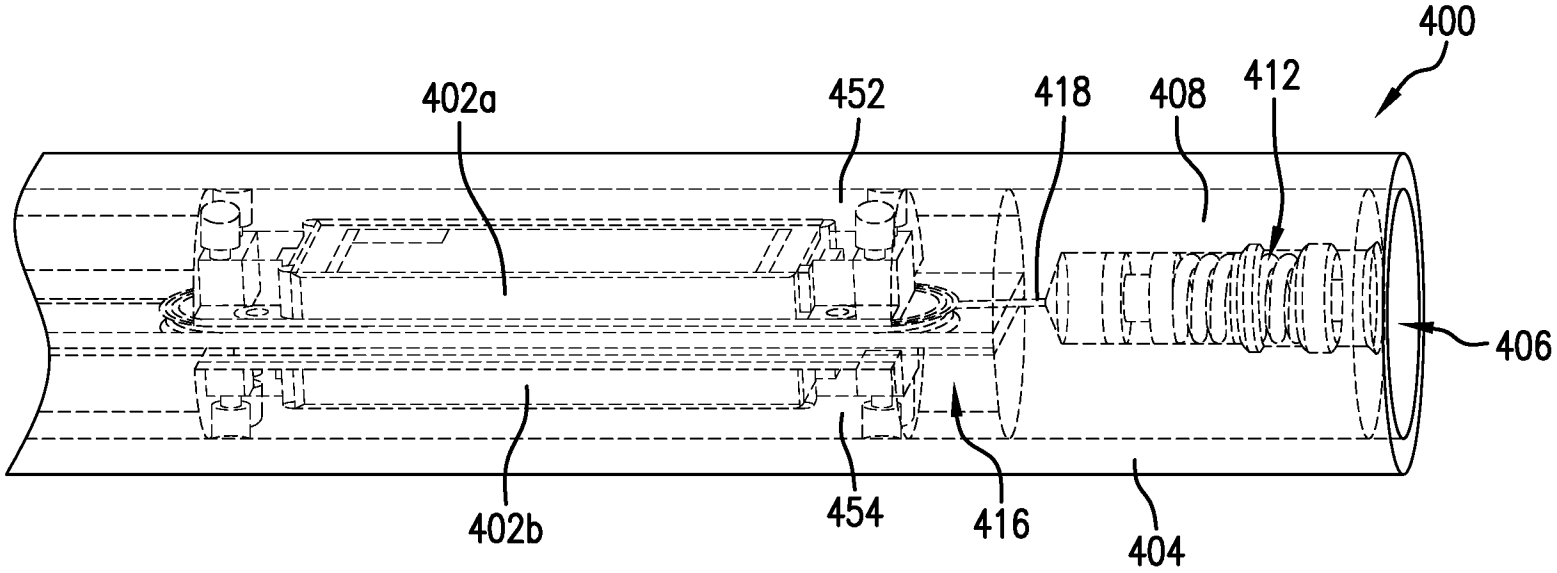
FIG. 4A is a schematic illustration of another non-limiting embodiment of a downhole component support system in accordance with the present disclosure.
Figure 4B:
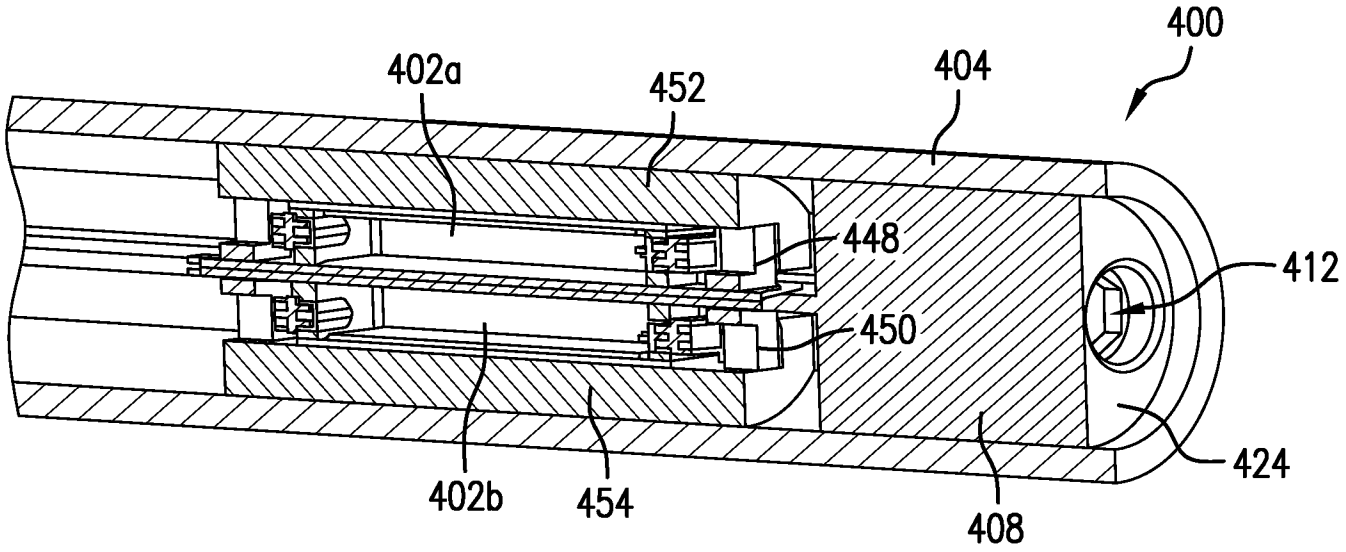
FIG. 4B is a cross-sectional illustration of the downhole component support system of FIG. 4A.
Figure 4C:
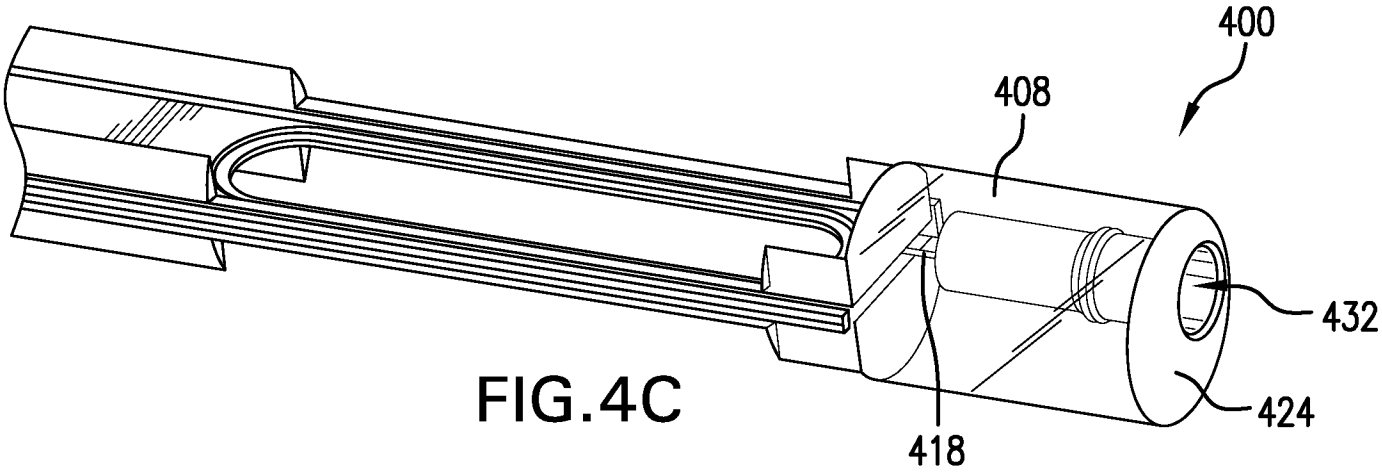
FIG. 4C is a schematic illustration of a portion of the downhole component support system of FIG. 4A.
Figure 4D:
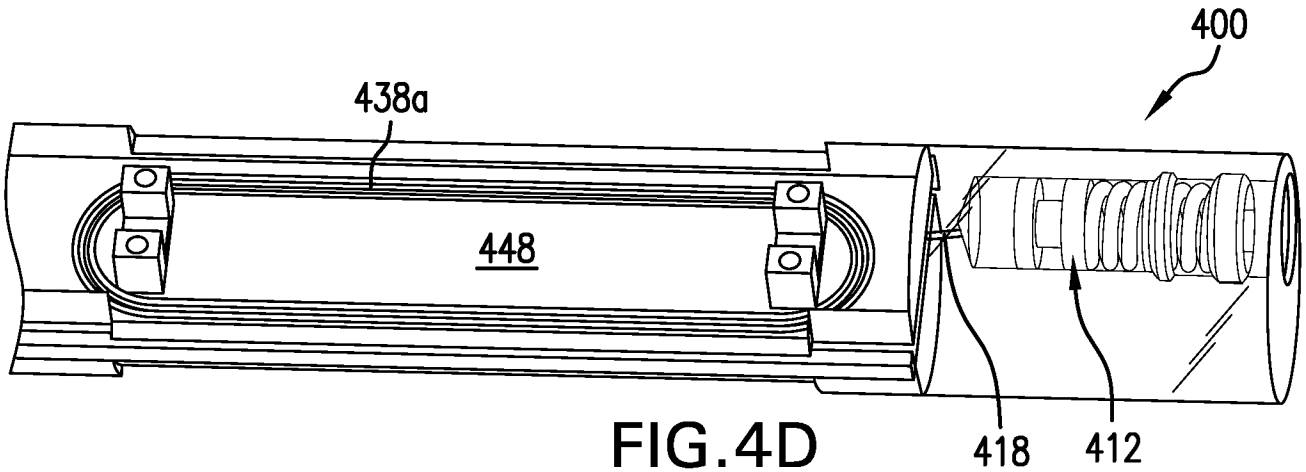
FIG. 4D is another schematic illustration of portions of the downhole component support system of FIG. 4A.
Figure 4E:
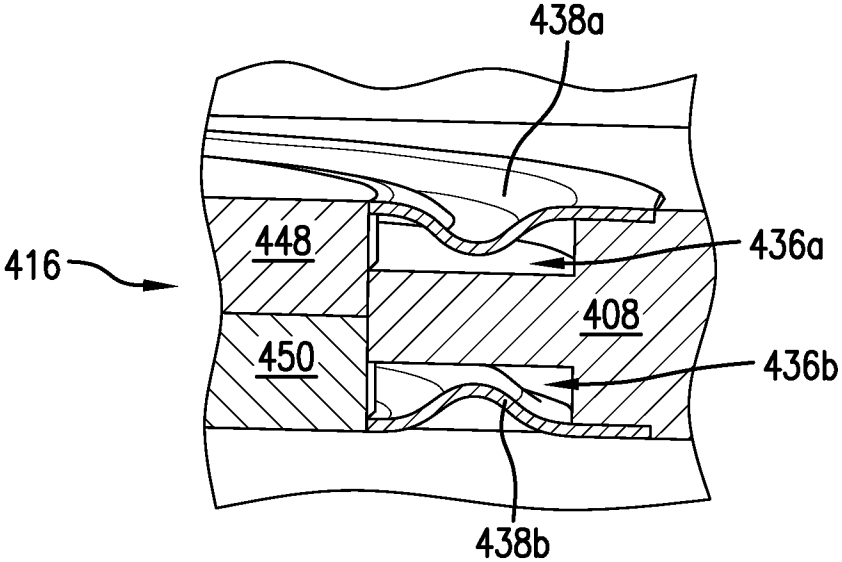
FIG. 4E is an enlarged schematic illustration of a portion of the downhole component support system of the FIG. 4A.

Turning now to FIGS. 4A-4E, schematic illustrations of another non-limiting embodiment of a downhole component support system 400 in accordance with the present disclosure are shown. FIG. 4A is a schematic illustration of the downhole component support system 400 as installed in a housing 404. FIG. 4B is a cross-sectional illustration of the downhole component support system 400 of FIG. 4A. FIG. 4C is a schematic illustration of an hydraulic frame 408 of the downhole component support system 400. FIG. 4D is a schematic illustration of the downhole component support system 400 of FIG. 4A illustrating a subframe 448 of the downhole component support system 400. FIG. 4E is a schematic illustration of a slave hydraulic assembly 416 of the downhole component support system 400.

With reference to FIGS. 4A-4E, the downhole component support system 400 includes an hydraulic frame 408 that fits within a housing cavity 406. The hydraulic frame 408 includes a first subframe 448 and a second subframe 450 that each support a respective component package 402*a*, 402*b*. That is, a component package 402*a*, 402*b* can be mounted to a respective subframe 448, 450. The hydraulic frame 408 can also include optional heat sinks 452, 454 that are configured to contain the component packages 402*a*, 402*b* and provide thermal cooling or improved heat transfer to the component packages 402*a*, 402*b*.

As shown, the downhole component support system 400 includes a single master hydraulic assembly 412 that is installed within a bore 432 of the hydraulic frame 408 that opens on an end 424 of the hydraulic frame 408. The master hydraulic assembly 412 includes a master assembly cavity, as described above, which is in hydraulic or fluid communication with a slave hydraulic assembly 416 through a fluid line 418. The master hydraulic assembly 412, as shown, is substantially similar to that shown and described above and thus similar features will not be described again.

The slave hydraulic assembly 416, in the downhole component support system 400 includes a first slave actuator 438*a* and a second slave actuator 438*b*, as shown in FIGS. 4D-4E. The slave actuators 438*a*, 438*b* in this embodiment are formed from bellows or membranes that can actuate based on hydraulic pressure. The slave actuators 438*a*, 438*b* can be fixedly attached to subframes 448, 450 and fixedly attached to the hydraulic frame 408. The attachment between the slave actuators 438*a*, 438*b* and the hydraulic frame 408 and the subframes 448, 450 can be hermetic seals to ensure the hydraulic fluid does not exit from slave assembly cavities 436*a*, 436*b*.

In operation, hydraulic fluid can be urged from the master assembly cavity, through the fluid line 418, and into the first and second slave assembly cavities 436*a*, 436*b*. The hydraulic fluid will then urge the slave actuators 438*a*, 438*b* to expand outward which can force the subframes 448, 450 outward and into engagement or contact with a portion of the hydraulic frame 408, an interior surface of the housing 404, or the heat sinks 452, 454, depending on the configuration of the downhole component support system 400. Advantageously, when the heat sinks 452, 454 are included, the heat sinks 452, 454 can provide thermal cooling and/or heat dissipation from the component packages 402*a*, 402*b*, which can further be distributed into and/or through the housing 404.

Those of skill in the art will appreciate that the various features of the different above described embodiments are not limited to the specific embodiments shown and described. That is, various features described herein can be substituted and/or combined and exchanged to form different structures or configurations of downhole component support systems without departing from the scope of the present disclosure.

Although shown and described herein as cylindrical in shape, the hydraulic frame and/or housing are not so limited. For example, in some embodiments, the housing and/or the housing cavity can have a square or other shape (even if an exterior surface of the housing is cylindrical). In such embodiments, the slave hydraulic assemblies can be configured to perform similar operation as described herein. Thus, the above described and shown embodiments are not to be limiting and various alternatives are contemplated without departing from the scope of the present disclosure.

Figure 5:
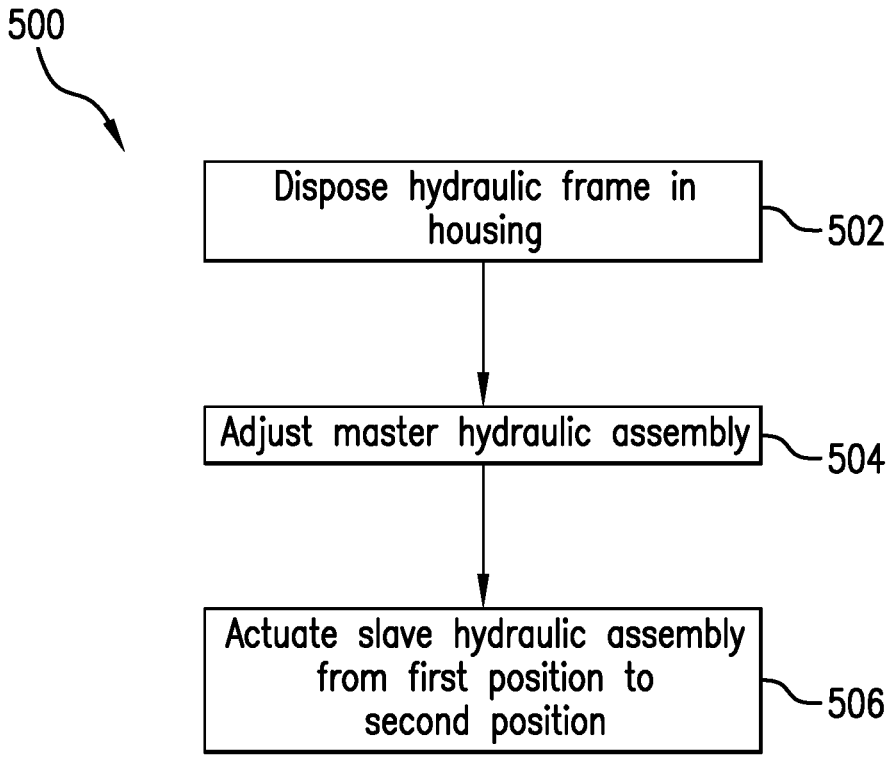
FIG. 5 is a flow process for installation a hydraulic frame within a cavity of a housing for a downhole tool in accordance with an embodiment of the present disclosure.

Turning now to FIG. 5, a flow process 500 for installation of an hydraulic frame into a housing of a downhole tool or component in accordance with the present disclosure is shown. The flow process 500 can be used for installation and/or removal of a hydraulic frame that supports one or more component packages within a housing. The flow process 500 can be used with the above described downhole component support systems and/or variations thereof. The flow process employs a downhole component support system that is hydraulic-based such that easy installation and removal can be achieved.

At block 502, an hydraulic frame is disposed in a housing cavity of a housing. The housing can be a downhole tool or a component or part of a downhole tool or structure. The hydraulic frame is inserted into the cavity through an aperture of the housing that is configured to receive the hydraulic frame. The hydraulic frame, as noted, can support one or more component packages.

At block 504, a master hydraulic assembly is adjusted to increase a hydraulic pressure within the downhole component support system. The adjustment may be made by control element or other structure and can be manually or automatically controlled. In some embodiments, the adjustment is through electrical and/or mechanical means.

At block 506, a slave hydraulic assembly is actuated from a first position toward a second position (e.g., from a retracted or disengaged position to an extended or engaged position). In some configurations, in the second position, a portion of the slave hydraulic assembly will contact or engage with an interior surface of the housing (e.g., FIGS. 2A-3). In other embodiments, in the second position, the slave hydraulic assembly will urge a subframe of the hydraulic frame outward (e.g., FIGS. 4A-4E). When in the second position, the hydraulic frame is secured, mounted to, or clamped to the housing such that the component packages can be protected from differential movement and/or vibrations. For example, in some configurations, a portion of the slave hydraulic assembly can contact an interior surface of the housing to thus retain the hydraulic frame in place. In other configurations, the slave assembly can be actuated to urge one or more subframes outward to engage a component package with an interior surface of the housing. Further still, in some configurations, the subframes can be urged to apply force on heat sinks that can contact and engage with an interior surface of the housing.

The reverse process can be performed to move the slave hydraulic assembly from the second position to the first position. When in the first position, the hydraulic frame can be removed from the housing cavity.

Advantageously, embodiments of the present disclosure enable easy installation, removal, repair, replacement, etc. of component packages into downhole tools. Further, advantageously, embodiment provided herein can enable secure clamping of hydraulic frames such that component packages mounted on the hydraulic frames can be protected or isolated from differential movement and/or vibration. Additionally, advantageously, embodiments of the present disclosure can provide additional heat dissipation for component packages while clamping an hydraulic frame within a cavity of a housing.

Embodiment 1

A downhole component support system is provided. The system includes a housing having a housing cavity therein, the housing cavity configured to contain a hydraulic frame; a hydraulic frame configured to support at least one component package removably disposed within the housing cavity; at least one master hydraulic assembly in hydraulic communication with the hydraulic frame; and at least one slave hydraulic assembly coupled to the hydraulic frame and hydraulically coupled to the at least one master hydraulic assembly, wherein adjustment of the at least one master hydraulic assembly urges the at least one slave hydraulic assembly between a first position and a second position, and wherein, in the second position, the hydraulic frame is secured to an interior surface of the housing.

Embodiment 2

The downhole component support system any of the embodiments described herein, wherein each slave hydraulic assembly is positioned on the hydraulic frame such that when in the second position at least one of a portion of the hydraulic frame or a portion of a component package contacts the interior surface of the housing.

Embodiment 3

The downhole component support system any of the embodiments described herein, wherein the at least one slave hydraulic assembly comprises at least three slave hydraulic assemblies equally positioned about a circumference of the hydraulic frame.

Embodiment 4

The downhole component support system any of the embodiments described herein, further comprising at least one frame biasing element configured to engage with the interior surface of the housing and position the hydraulic frame within the housing cavity.

Embodiment 5

The downhole component support system any of the embodiments described herein, further comprising a fluid line fluidly coupling the at least one master hydraulic assembly to the at least one slave hydraulic assembly.

Embodiment 6

The downhole component support system any of the embodiments described herein, wherein the fluid line fluidly couples one master hydraulic assembly with a plurality of slave hydraulic assemblies.

Embodiment 7

The downhole component support system any of the embodiments described herein, further comprising at least one flow control element coupled to the fluid line to control a fluid flow between the at least one master hydraulic assembly and the at least one slave hydraulic assembly.

Embodiment 8

The downhole component support system any of the embodiments described herein, wherein the at least one flow control element is selected to dampen an acceleration of the hydraulic frame with respect to the housing cavity.

Embodiment 9

The downhole component support system any of the embodiments described herein, wherein the at least one component package is an electronics package.

Embodiment 10

The downhole component support system any of the embodiments described herein, wherein the at least one master hydraulic assembly includes a control element accessible when the hydraulic frame is disposed within the housing cavity; a master actuator configured to be adjusted by the control element to adjust a hydraulic pressure; and wherein the at least one slave actuator is configured to exert force by the hydraulic pressure between the hydraulic frame and the housing cavity to abate differential movement at the position of the at least one slave actuator.

Embodiment 11

The downhole component support system any of the embodiments described herein, wherein: the hydraulic frame comprises at least one subframe, the at least one slave hydraulic assembly includes a membrane fixedly attached to the at least one subframe, and when the slave hydraulic assembly is urged between the first position and the second position, the at least one subframe is adjusted in position.

Embodiment 12

The downhole component support system any of the embodiments described herein, further comprising a heat sink disposed between the at least one component package and the interior surface of the housing.

Embodiment 13

The downhole component support system any of the embodiments described herein, wherein the heat sink is energized by the at least one slave hydraulic assembly and urged into contact with the housing when the at least one slave hydraulic assembly is in the second position.

Embodiment 14

A method for installing component packages within a housing of a downhole tool, the method comprising: inserting a hydraulic frame into a housing cavity of the housing, the hydraulic frame configured to support at least one component package, the hydraulic frame having at least one master hydraulic assembly in hydraulic communication with the hydraulic frame and at least one slave hydraulic assembly hydraulically coupled to the at least one master hydraulic assembly, adjusting the at least one master hydraulic assembly to urge the at least one slave hydraulic assembly between a first position and a second position; and securing the hydraulic frame within the housing with the at least one slave hydraulic assembly in the second position.

Embodiment 15

The method of any of the embodiments described herein, wherein each slave hydraulic assembly is positioned on the hydraulic frame such that when in the second position at least one of a portion of the hydraulic frame or a portion of a component package contacts the interior surface of the housing.

Embodiment 16

The method of any of the embodiments described herein, wherein the at least one slave hydraulic assembly comprises at least three slave hydraulic assemblies equally positioned about a circumference of the hydraulic frame.

Embodiment 17

The method of any of the embodiments described herein, wherein the hydraulic frame includes at least one frame biasing element configured to engage with the interior surface of the housing and position the hydraulic frame within the housing cavity.

Embodiment 18

The method of any of the embodiments described herein, wherein the hydraulic frame includes a fluid line fluidly coupling the at least one master hydraulic assembly to the at least one slave hydraulic assembly.

Embodiment 19

The method of any of the embodiments described herein, wherein the fluid line fluidly couples one master hydraulic assembly with a plurality of slave hydraulic assemblies.

Embodiment 20

The method of any of the embodiments described herein, further comprising controlling a flow between the at least one master hydraulic assembly and the at least one slave hydraulic assembly with a flow control element coupled to the fluid line.

Embodiment 21

The method of any of the embodiments described herein, wherein the at least one master hydraulic assembly comprises a control element accessible when the hydraulic frame is inserted into the housing cavity, a master actuator configured to be adjusted by the control element to adjust a hydraulic pressure, the method further comprising: adjusting the at least one master hydraulic assembly comprises adjusting a position of the control element relative to the hydraulic frame.

Embodiment 22

The method of any of the embodiments described herein, wherein the hydraulic frame comprises at least one subframe, the at least one slave hydraulic assembly includes a membrane fixedly attached to the at least one subframe, and when the slave hydraulic assembly is urged between the first position and the second position, the at least one subframe is adjusted in position.

Embodiment 23

The method of any of the embodiments described herein, wherein the hydraulic frame further comprises a heat sink disposed between the at least one component package and the interior surface of the housing.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A downhole component support system, the downhole component support system comprising:

a housing having a housing cavity therein;

a hydraulic frame disposed within the housing cavity and configured to support at least one electronics package;

at least one master hydraulic assembly in hydraulic communication with the hydraulic frame, the at least one master hydraulic assembly having a fluid cavity from which a hydraulic fluid is discharged; and at least one slave hydraulic assembly having a fluid cavity for receiving the discharged hydraulic fluid and coupled to the hydraulic frame and fluidly coupled to the at least one master hydraulic assembly by the hydraulic fluid, wherein adjustment of the at least one master hydraulic assembly causes the hydraulic fluid to apply force to the at least one slave hydraulic assembly and urge the at least one slave hydraulic assembly between a first position and a second position, and wherein, in the second position, the hydraulic frame is secured to an interior surface of the housing.

2. The downhole component support system of claim 1, further comprising at least one electronics package supported by the hydraulic frame, wherein the at least one slave hydraulic assembly is positioned on the hydraulic frame such that when in the second position at least one of a portion of the hydraulic frame or a portion of the at least one electronics package contacts the interior surface of the housing.

3. The downhole component support system of claim 1, wherein the at least one slave hydraulic assembly comprises at least three slave hydraulic assemblies equally positioned about a circumference of the hydraulic frame.

4. The downhole component support system of claim 3, further comprising at least one frame biasing element, each of the at least one frame biasing element having a compressible portion between a first end and a second end, the at least one frame biasing element configured to engage with the interior surface of the housing and position the hydraulic frame within the housing cavity.

5. The downhole component support system of claim 1, further comprising a fluid line connecting the at least one master hydraulic assembly to the at least one slave hydraulic assembly such that the hydraulic fluid is configured to flow through the fluid line between the at least one master hydraulic assembly and the at least one slave hydraulic assembly.

6. The downhole component support system of claim 5, wherein the fluid line fluidly couples the at least one master hydraulic assembly with a plurality of slave hydraulic assemblies.

7. The downhole component support system of claim 5, further comprising at least one flow control element in the fluid line to control a fluid flow between the at least one master hydraulic assembly and the at least one slave hydraulic assembly, the flow control element being selected from the group consisting of nozzles, restrictors, and check valves.

8. The downhole component support system of claim 7, wherein the at least one flow control element is selected to dampen an acceleration of the hydraulic frame with respect to the housing cavity.

9. The downhole component support system of claim 1, wherein the at least one master hydraulic assembly comprises:

a control element that is accessible by an operator when the hydraulic frame is disposed within the housing cavity, the control element having a positionable surface;

a master actuator, the master actuator having a surface for compressing the hydraulic fluid in the master hydraulic assembly cavity, the master actuator configured to be adjusted by the control element to adjust a hydraulic pressure of the hydraulic fluid; and wherein the at least one slave hydraulic assembly comprises at least one slave actuator, the at least one slave actuator having an expandable member, the at least one slave actuator expandable member configured to actuate in response to the hydraulic pressure to engage with the interior surface of the housing to abate differential movement of the hydraulic frame relative to the housing at the location of the at least one slave actuator.

10. The downhole component support system of claim 1, wherein:

the hydraulic frame comprises at least one subframe, the at least one slave hydraulic assembly includes a membrane fixedly attached to the at least one subframe, and when the at least one slave hydraulic assembly is urged between the first position and the second position, the at least one subframe is adjusted in position.

11. The downhole component support system of claim 1, further comprising a heat sink disposed between the at least one electronics package and the interior surface of the housing.

12. The downhole component support system of claim 11, wherein the heat sink is energized by the at least one slave hydraulic assembly and urged into contact with the housing when the at least one slave hydraulic assembly is in the second position.

13. A method for installing at least one electronics package within a housing of a downhole tool, the method comprising:

inserting a hydraulic frame into a housing cavity of the housing, the hydraulic frame configured to support the at least one electronics package within the housing, the hydraulic frame having at least one master hydraulic assembly having a fluid cavity from which a hydraulic fluid is discharged, the at least one master hydraulic assembly in hydraulic communication with the hydraulic frame and at least one slave hydraulic assembly having a fluid cavity for receiving the discharged hydraulic fluid, the at least one slave hydraulic assembly fluidly coupled to the at least one master hydraulic assembly by the hydraulic fluid, adjusting the at least one master hydraulic assembly to cause the hydraulic fluid to apply force to the at least one slave hydraulic assembly and urge the at least one slave hydraulic assembly between a first position and a second position; and securing the hydraulic frame within the housing with the at least one slave hydraulic assembly in the second position.

14. The method of claim 13, wherein the at least one slave hydraulic assembly is positioned on the hydraulic frame such that when in the second position at least one of a portion of the hydraulic frame or a portion of the at least one electronics package contacts an interior surface of the housing.

15. The method of claim 13, wherein the at least one slave hydraulic assembly comprises at least three slave hydraulic assemblies equally positioned about a circumference of the hydraulic frame.

16. The method of claim 13, wherein the hydraulic frame includes at least one frame biasing element, each of the at least one frame biasing element having a compressible portion between a first end and a second end, the at least one frame biasing element configured to engage with an interior surface of the housing and position the hydraulic frame within the housing cavity.

17. The method of claim 13, wherein the hydraulic frame includes a fluid line fluidly coupling the at least one master hydraulic assembly to the at least one slave hydraulic assembly.

18. The method of claim 17, further comprising controlling a flow between the at least one master hydraulic assembly and the at least one slave hydraulic assembly with a flow control element in the fluid line, the flow control element being selected from the group consisting of nozzles, restrictors, and check valves.

19. The method of claim 13, wherein the at least one master hydraulic assembly comprises a control element that is accessible by an operator during or after the hydraulic frame is inserted into the housing cavity, the control element having a positionable surface, a master actuator, the master actuator having a surface for compressing the hydraulic fluid in the master hydraulic assembly cavity, the master actuator surface configured to be adjusted by the control element to adjust a hydraulic pressure of the hydraulic fluid, and wherein:

adjusting the hydraulic pressure of the hydraulic fluid using the at least one master hydraulic assembly by adjusting a position of the control element positionable surface relative to the hydraulic frame.

20. A downhole component support system, the downhole component support system comprising:

a housing having a housing cavity therein;

a hydraulic frame disposed within the housing cavity and configured to support at least one component package;

at least one master hydraulic assembly in hydraulic communication with the hydraulic frame, the at least one master hydraulic assembly having a fluid cavity from which a hydraulic fluid is discharged; and at least one slave hydraulic assembly having a fluid cavity for receiving the discharged hydraulic fluid, and coupled to the at least one master hydraulic assembly by the hydraulic fluid, wherein adjustment of the at least one master hydraulic assembly causes the hydraulic fluid to apply force to the at least one slave hydraulic assembly and urge the at least one slave hydraulic assembly between a first position and a second position, and wherein, in the second position, the hydraulic frame is secured to an interior surface of the housing, wherein the at least one master hydraulic assembly comprises:

a control element that is accessible by an operator when the hydraulic frame is disposed within the housing cavity, the control element having a positionable surface;

a master actuator, the master actuator having a surface for compressing the hydraulic fluid in the master hydraulic assembly cavity, the master actuator configured to be adjusted by the control element to adjust a hydraulic pressure of the hydraulic fluid; and wherein the at least one slave hydraulic assembly comprises:

at least one slave actuator having an expandable member, the at least one slave actuator expandable member configured to actuate in response to the hydraulic pressure to engage with the interior surface of the housing to abate differential movement of the hydraulic frame relative to the housing at the location of the at least one slave actuator.

21. A downhole component support system, the downhole component support system comprising:

a housing having a housing cavity therein;

a hydraulic frame disposed within the housing cavity and configured to support at least one component package;

at least one master hydraulic assembly in hydraulic communication with the hydraulic frame, the at least one master hydraulic assembly having a fluid cavity from which a hydraulic fluid is discharged; and at least one slave hydraulic assembly having a fluid cavity for receiving the discharged hydraulic fluid, and coupled to the at least one master hydraulic assembly by the hydraulic fluid, wherein adjustment of the at least one master hydraulic assembly causes the hydraulic fluid to apply force to the at least one slave hydraulic assembly and urge the at least one slave hydraulic assembly between a first position and a second position, wherein, in the second position, the hydraulic frame is secured to an interior surface of the housing, and wherein the hydraulic frame comprises at least one subframe, the at least one slave hydraulic assembly includes a membrane fixedly attached to the at least one subframe, and, when the at least one slave hydraulic assembly is urged between the first position and the second position, the at least one subframe is adjusted in position.

22. A downhole component support system, the downhole component support system comprising:

a housing having a housing cavity therein;

a hydraulic frame disposed within the housing cavity and configured to support at least one component package;

at least one master hydraulic assembly in hydraulic communication with the hydraulic frame, the at least one master hydraulic assembly having a fluid cavity from which a hydraulic fluid is discharged; and at least one slave hydraulic assembly having a fluid cavity for receiving the discharged hydraulic fluid, and coupled to the at least one master hydraulic assembly by the hydraulic fluid, a heat sink disposed between the at least one component package and the interior surface of the housing, wherein adjustment of the at least one master hydraulic assembly causes the hydraulic fluid to apply force to the at least one slave hydraulic assembly and urge the at least one slave hydraulic assembly between a first position and a second position, and wherein, in the second position, the hydraulic frame is secured to the interior surface of the housing.

23. A downhole component support system, the downhole component support system comprising:

a housing having a housing cavity therein;

a hydraulic frame disposed within the housing cavity and configured to support at least one component package;

at least one master hydraulic assembly in hydraulic communication with the hydraulic frame, the at least one master hydraulic assembly having a fluid cavity from which a hydraulic fluid is discharged;

a plurality of slave hydraulic assemblies each having a fluid cavity for receiving the discharged hydraulic fluid, and coupled to the at least one master hydraulic assembly by the hydraulic fluid; and a fluid line connecting the at least one master hydraulic assembly to the plurality of slave hydraulic assemblies such that the hydraulic fluid is configured to flow through the fluid line between the at least one master hydraulic assembly and the plurality of slave hydraulic assemblies;

wherein adjustment of the at least one master hydraulic assembly causes the hydraulic fluid to apply force to the plurality of slave hydraulic assemblies and urge each of the plurality of slave hydraulic assemblies between a first position and a second position, and wherein, in the second position of the plurality of slave hydraulic assemblies, the hydraulic frame is secured to an interior surface of the housing.

* * * * *